US007795536B2

(12) United States Patent
Plourde et al.

(10) Patent No.: US 7,795,536 B2
(45) Date of Patent: Sep. 14, 2010

(54) ULTRA HIGH-SPEED COAXIAL CABLE

(75) Inventors: Kenneth Plourde, Upton, MA (US); Ronald Poklemba, Marlborough, MA (US); Jeffrey Gasek, Hopkinton, MA (US)

(73) Assignee: Temp-Flex Cable, Inc., South Grafton, MA (US)

( * ) Notice: Subject to any disclaimer, the term of this patent is extended or adjusted under 35 U.S.C. 154(b) by 163 days.

(21) Appl. No.: 12/137,653

(22) Filed: Jun. 12, 2008

(65) Prior Publication Data

US 2009/0183897 A1 Jul. 23, 2009

Related U.S. Application Data

(60) Provisional application No. 61/021,929, filed on Jan. 18, 2008.

(51) Int. Cl.
*H01B 7/18* (2006.01)
*H01B 7/00* (2006.01)

(52) U.S. Cl. ..... 174/102 R; 174/110 R; 174/120 R

(58) Field of Classification Search ..... 174/110 R, 174/110 FC, 110 F, 113 R, 113 AS, 113 C, 174/120 C, 102 R, 107, 108
See application file for complete search history.

(56) References Cited

U.S. PATENT DOCUMENTS

| | | | | |
|---|---|---|---|---|
| 4,894,488 | A * | 1/1990 | Gupta | 174/28 |
| 6,335,490 | B1 * | 1/2002 | Higashikubo et al. | 174/110 F |
| 6,538,050 | B1 * | 3/2003 | Weilandt et al. | 523/219 |
| 6,583,226 | B1 * | 6/2003 | Kaulbach et al. | 525/199 |
| 6,599,626 | B1 * | 7/2003 | Cogen et al. | 428/379 |
| 2004/0074654 | A1 * | 4/2004 | Springer et al. | 174/28 |
| 2004/0236047 | A1 * | 11/2004 | Ono et al. | 526/247 |
| 2004/0260044 | A1 * | 12/2004 | Earnest et al. | 526/247 |
| 2005/0080211 | A1 * | 4/2005 | Earnest et al. | 526/247 |
| 2005/0173674 | A1 * | 8/2005 | Globus et al. | 252/301.5 |
| 2005/0187328 | A1 * | 8/2005 | Globus et al. | 524/430 |
| 2008/0166537 | A1 * | 7/2008 | Frankowski et al. | 428/304.4 |
| 2008/0283271 | A1 * | 11/2008 | Kenny et al. | 174/110 F |

* cited by examiner

*Primary Examiner*—William H Mayo, III
(74) *Attorney, Agent, or Firm*—McCormick, Paulding & Huber LLP

(57) ABSTRACT

A cable for the ultra high-speed communication of high-frequency signals. The cable includes a longitudinal conductor and an insulator sheath at least partially covering the longitudinal conductor. The cable further includes an inner conductive sheath disposed about an outer periphery of the insulator sheath and an outer insulator jacket disposed about an outer periphery of the inner conductive sheath. The insulator sheath is manufactured from a high-purity fluorinated ethylene propylene.

20 Claims, 3 Drawing Sheets

ULTRA HIGH-SPEED COAXIAL CABLE

CROSS-REFERENCE TO RELATED APPLICATION

This application claims the benefit of U.S. Provisional Application Ser. No. 61/021,929, filed on Jan. 18, 2008, which is hereby incorporated by reference in its entirety.

FIELD OF THE INVENTION

This invention relates to electrical cables and, more specifically, to coaxial-type electrical cables.

BACKGROUND OF THE INVENTION

Coaxial cables are a type of electrical cable used most oftentimes to carry high-frequency communication signals, e.g., signals that range from a fraction of a megahertz to tens of gigahertz in frequency. A typical coaxial cable includes a central conductor (or group of conductors), a dielectric insulator covering the central conductor, an inner cylindrical conducting shield or sheath (which is coaxial with the central conductor and which provides a signal reference or ground), and an outer insulating jacket. Ideally, the electromagnetic field carrying the signal exists only in the space between the central conductor and the inner shield, with the sheath reducing interference from external sources.

The dissipation factor of insulator material has a direct effect on the insertion loss results. In the case of coaxial cables, the lower the dissipation factor at frequencies greater than 1 GHz, the greater the performance levels. Dissipation Factor is expressed as the ratio of the resistive power loss to the capacitive power, and is equal to the tangent of the loss angle.

PTFE (polytetrafluoroethylene, e.g., DuPont Teflon®) is a synthetic fluoropolymer commonly used in the industry as the dielectric insulator in coaxial cables. PTFE insulators are implemented either in solid form or in expanded form, which is where air bubbles are incorporated into the PTFE material to lower its overall dielectric constant. PTFE has excellent electrical characteristics. However, as a thermoset material, PTFE cannot be melt processed, and is usually formed using a ram extrusion process. Here, a metering device is used to feed a measured amount of PTFE powder (paste) into a cylindrical extrusion pipe, where it is compressed by means of a hydraulic ram through an appropriately sized die onto a conductor.

The compressed PTFE powder/paste coated conductor is then transported through downstream ovens, where it is heated to dry off any extrusion aid and to sinter the PTFE insulation. This process can be effective for certain applications, but in the case of electrical cabling it is difficult to produce PTFE insulators with high dimensional tolerances, e.g., on a per-length basis, the thickness of the PTFE insulator may vary significantly. For high-frequency applications, such variances significantly negatively affect a cable's performance. Also, the PTFE ram extrusion process requires a large amount of machinery to carry out, and it is difficult to make lengthy continuous sections of electrical cable, since the sinter boundaries between rammed charges exhibit poor and/or variable electrical characteristics.

To overcome the aforementioned limitations of the prior art, it is a general object of the present invention to provide a coaxial cable having a central conductor group, an inner conductive sheath or shield coaxial with the central conductor group, and a high-purity FEP (fluorinated ethylene propylene) dielectric insulator disposed between the two. (Conductor "group" refers to one or more insulated or non-insulated conductors, including single and multiple solid conductors, stranded conductors, plated conductors, e.g., silver plated copper, and the like.) An outer insulator jacket and (optionally) an outer braided shield are disposed over the inner conductive shield. Although FEP is widely considered to be inferior to PTFE in the context of high-frequency coaxial and other electrical cables, the coaxial cable of the present invention utilizes an extruded, high-purity FEP material for the dielectric insulator. "High-purity" refers to FEP that is processed to have fewer impurities than a conventional FEP (and therefore a chemical structure that more closely approaches that of an ideal or theoretical FEP), and is defined as an FEP having a dissipation factor of 0.0005 or less at 2.45 GHz, as discussed in more detail below. Utilizing this type of insulator, the coaxial cable of the present invention is essentially equal to the electrical properties of a conventional coaxial cable having a PTFE dielectric insulator.

SUMMARY OF THE INVENTION

It is an object of the present invention to provide a cable for the transmission of high-frequency signals.

It is a further object of the present invention to provide a coaxial cable for the ultra high-speed transmission of high-frequency signals.

It is an additional object of the present invention to provide a coaxial cable that has a low dissipation factor.

It is another object of the present invention to provide a coaxial cable/using an insulator that has a low dissipation factor and that may be easily manufactured through a melt extrusion process.

It is yet another object of the present invention to provide a coaxial cable that has a low dissipation factor, that may be easily manufactured through a melt extrusion process and that has high dimensional tolerances.

It is an additional object of the present invention to provide a ultra high-speed, high-frequency coaxial cable that includes an insulator sheath of a high-purity fluorinated ethylene propylene facilitating the manufacture of a cable that has a low dissipation factor, that may be easily manufactured through a melt extrusion process and that has high dimensional tolerances.

An embodiment of the present invention is a cable for the communication of high-frequency signals. The cable includes a longitudinal conductor and an insulator sheath at least partially covering the longitudinal conductor. The cable further includes an inner conductive sheath disposed about an outer periphery of the insulator sheath and an outer insulator jacket disposed about an outer periphery of the inner conductive sheath. The insulator sheath is manufactured from a high-purity fluorinated ethylene propylene.

BRIEF DESCRIPTION OF THE DRAWINGS

The present invention will be better understood from reading the following description of non-limiting embodiments, with reference to the attached drawings, wherein below.

DETAILED DESCRIPTION

Figure 1:
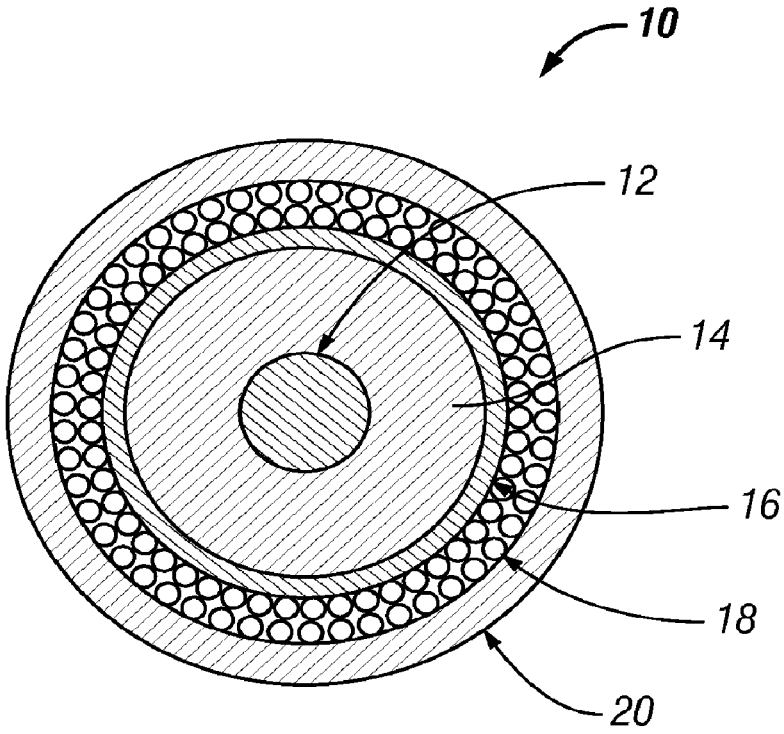
FIG. 1 is a cross section view of a coaxial cable according to a first embodiment of the present invention.

With reference to FIG. 1, one embodiment of the present invention relates to a coaxial-type electrical cable 10 having a central, longitudinal conductor 12, a generally cylindrical dielectric insulator 14 disposed about the central conductor 12, an inner conductive shield or sheath 16 disposed over the insulator 14, an outer, braided conductive shield 18, and an outer insulator jacket 20 made of FEP or another insulator. As indicated, the various elements are coaxial with one another, and share a common longitudinal axis. The dielectric insulator 14 is composed of a high-purity FEP material, as discussed in more detail below.

Figure 2:
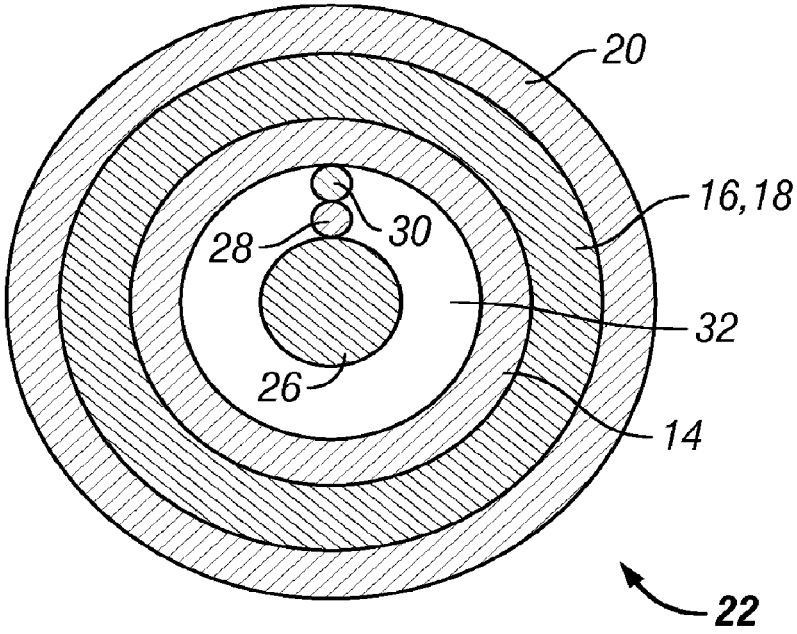
FIG. 2 is a cross section view of an additional embodiment of the coaxial cable, taken along line 2-2 in FIG. 3.
Figure 3:
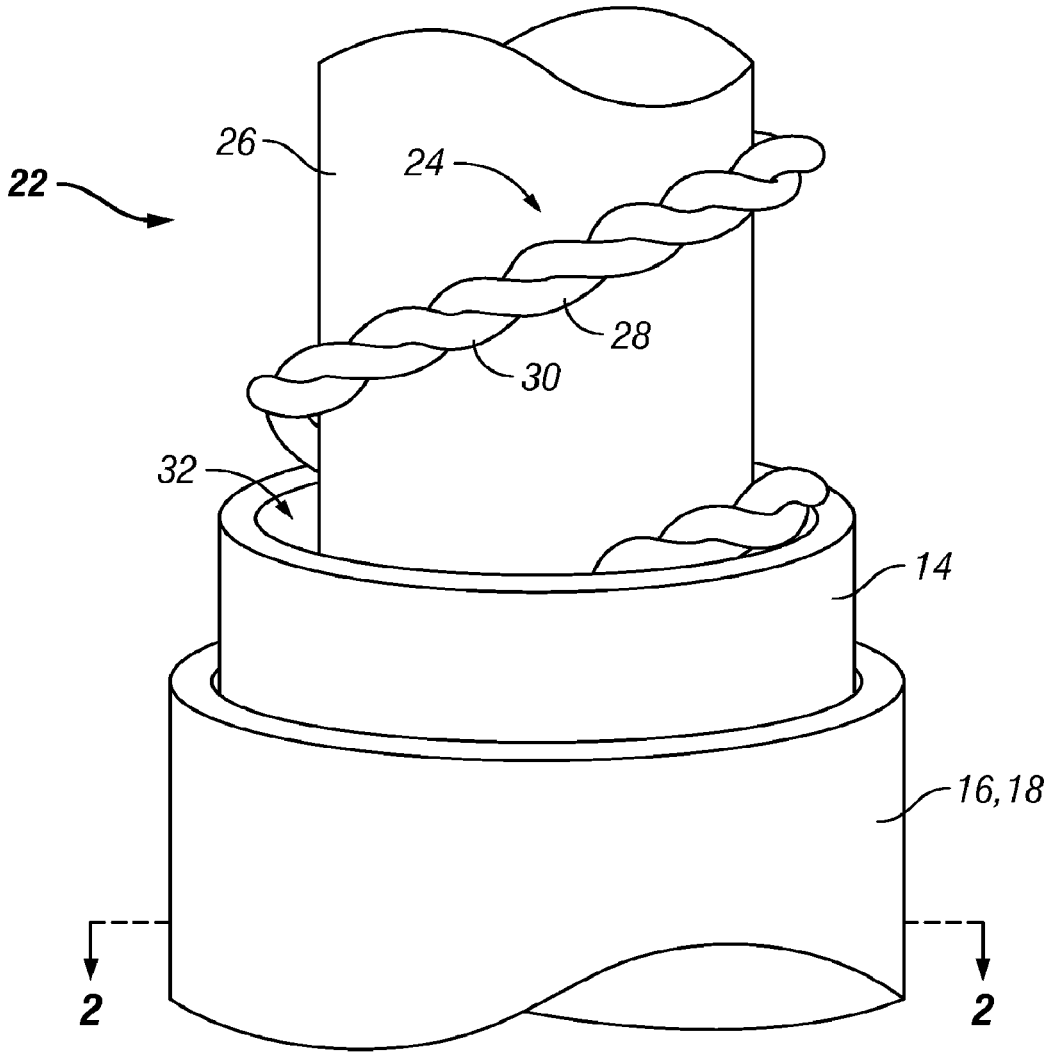
FIG. 3 is a perspective view of part of the cable shown in FIG. 2 (not necessarily to scale)

With reference to FIGS. 2 and 3, in an additional embodiment of the cable 22, a dual-filament insulator wrap 24 is wound around a central conductor group 26. (In this example, the central conductor is a single solid conductor.) The insulator wrap 24 includes first and second insulator filaments 28, 30 that are helically twisted together. The insulator wrap 24 is helically wound about the central conductor 26 along its length, with the conductor 26 and insulator wrap 24 being covered by the cylindrical high-purity FEP insulator 14. The dual-filament insulator wrap 24 establishes a partial air gap 32 between the insulator 14 and central conductor 26, reducing the effective dielectric constant of the region between the central conductor 26 and inner shield 16. Further information about the dual-filament wrap 24 can be found in U.S. Pat. No. 6,812,401 to Karrmann, dated Nov. 2, 2004, which is incorporated by reference herein in its entirety.

As mentioned above, the central conductor 12, 26 will typically comprise one or more insulated or non-insulated conductors, including single conductors (such as those shown in FIGS. 1, 2 and 3) and multiple solid conductors. Stranded conductors, plated conductors, and other types of longitudinal conductors may also be used, depending on the electrical properties desired for the cable. For high bandwidth applications, e.g., in the microwave range, both silver plated copper and silver plated copper clad steel conductors have proven advantageous.

The inner conductive shield 16 will typically be connected to act as a signal ground or other voltage reference for the electrical signals carried by the cable 10, 22, e.g., the inner shield 16 is terminated at a ground/reference portion of the cable end connector(s). The inner shield 16, is helically wrapped plain or silver plated copper foil or tape which can provide up to 100% coverage of the cable interior if the inner shield is formed using a helically overlapping wrapping procedure. Other options include copper braid or mesh, and other generally cylindrical wraps or sheaths made of other types of conductive materials.

The outer conductive shield 18 may be a braided sheath/shield made of silver plated copper wire or similar conductor, as are commonly used in the industry. A braided copper shield can provide greater than 90% coverage of the cable interior, and reinforces the inner shield both mechanically and electrically, i.e., the braided shield helps to reduce both signal leakage and external interference.

The dielectric insulator 14 is a generally cylindrical body directly or indirectly disposed over and coaxial with the central conductor 12, 26. In the cable 10 shown in FIG. 1, the insulator 14 maintains an even and uniform spacing between the central conductor 12 and inner conductive shield 16. In the cable 22 shown in FIG. 2, the insulator 14 works in conjunction with the dual-filament wrap 24, again, for maintaining an even and uniform spacing between the central conductor 26 and inner conductive shield 16. The insulator 14 also ensures that the inner shield does not contact the central conductor, in the spaces between the dual-filament wrap, if the cable is bent or otherwise deformed during use.

As noted above, the dielectric insulator 14 is composed of FEP, which refers to fluorinated ethylene propylene. Generally speaking, FEP is produced by copolymerization of tetrafluoroethylene and hexafluoropropylene. It is a relatively soft, chemically inert thermoplastic with a high degree of stress crack resistance, a low coefficient of friction, and reasonably good levels of heat resistance, tensile strength, wear resistance, and creep resistance. Although FEP has good electrical characteristics in a general sense, it exhibits significantly poorer electrical characteristics than PTFE at microwave level frequencies, e.g., at frequencies above 1 GHz. Thus, even though FEP has been used to insulate electrical cables in the past, primarily because of its superior manufacturing properties (see, e.g., the aforementioned U.S. Pat. No. 6,812,401), this has been at the expense of electrical performance in the high-frequency range, in comparison to PTFE-based cables.

In the cables 10, 22 of the present invention, however, the dielectric insulator 14 is a high-purity FEP material. "High-purity" refers generally to FEP that is manufactured or processed so as to have fewer impurities than a typical FEP. In particular, when chemical base materials are processed to manufacture a polymer such as FEP, impurities are present in the chemicals themselves, and are introduced from the manufacturing environment. If stricter quality control measures are undertaken, however, it is possible to manufacture an FEP with fewer of such impurities. Since there are fewer impurities, FEP of this type has a chemical structure that more closely approaches that of an ideal or theoretical FEP. Thus, although FEP has a significantly less uniform crystalline structure than PTFE (since FEP is a copolymer), and as a result carries a less symmetric distribution of electrical charge than PTFE during signal load, it is believed that high-purity FEP presents a crystalline structure that is "good enough," versus conventional FEP, for improved electrical characteristics at high frequencies. In other words, whereas conventional FEP (with high levels of impurities) presents a significantly "uneven" boundary between the conductor and dielectric, and therefore an uneven distribution of charge, electromagnetic flux lines, etc., high-purity FEP reduces this level of unevenness, resulting in high-frequency electrical characteristics that essentially equal to those of PTFE, in the context of a coaxial cable dielectric insulator.

Because polymer manufacturers typically categorize different grades of FEP in terms of recommended categories of use, with a listing of mechanical and other properties but without an indication of the precise chemical makeup of the material, impurity levels, etc., potential FEP materials for use with the cables 10, 22 are best assessed according to (i) the manufacturer's general characterization of grade and intended use and (ii) the actual electrical properties of the material. The former indicator is optionally used to "weed out" candidate materials that are unlikely to have the requisite purity level, such as FEP that is characterized by the manufacturer as "low grade," or that is designated for non-electrical use. In regards to the latter, certain electrical properties are a function of the purity level of the material, and can therefore be used to directly assess the FEP in question. Dissipation factor is one such property, and is used herein to define the scope of what is meant by a "high-purity" FEP.

To explain further, signal transmission down a length of cable occurs mainly at the conductor/insulation interface.

The tendency of an insulator to dissipate or absorb electrical signal energy in the form of heat, which is referred to as the "dissipation factor" of the insulator (a measurable, numerical value), is one of the causes of signal attenuation. Dissipation Factor, ("DF"), is expressed as the ratio of the resistive power loss to the capacitive power, and is equal to the tangent of the loss angle. Higher levels of impurities in a material result in a higher dissipation factor, since the structure of the material has a greater degree of irregularity along the conductor/insulator interface. As with dielectric constant, dissipation factor is a function of signal frequency and temperature. Higher temperatures and higher signal frequencies increase dissipation and therefore attenuation.

In the case of the high-purity FEP dielectric insulator 14 of the cables 10, 22, "high-purity" is defined as the FEP material having a dissipation factor of 0.0005 or less at 2.45 GHz. It has been found that an FEP material with this (or a lower) dissipation factor at this frequency provides performance levels essentially equal to those of PTFE for high-frequency coaxial cables. By way of comparison, a typical FEP material has a dissipation factor of 0.0008-0.0012 at this frequency. The dissipation factor of a material may be measured using standard methods, such as those set forth in the ASTM D150 or IEC 60250 standards, e.g., plate electrode testing using a high-frequency LCR meter or impedance analyzer. The 2.45 GHz frequency level was arbitrarily chosen as lying within the high-frequency range of interest, e.g., frequencies greater than 1 GHz.

One high-purity FEP material that is suitable for the dielectric insulator 14 is Daikin Neoflon® FEP NP-1101, which was originally developed for use in injection molding of thin wall parts, and for high-speed extrusion of very thin coatings of small size wires. Neoflon® FEP NP-1101 has the following properties: melt flow rate, g/10 min=18-26.5; melting point (DSC)=245-270° C.; tensile strength>20.0 MPa; elongation>300%, all measured according to ASTM D-2116; and an MIT flex>3000 cycles, measured according to ASTM D-2176.

The coaxial cables 10, 22 are manufactured using standard methods, such as those described in U.S. Pat. No. 6,812,401. The high-purity FEP dielectric insulator 14, whether disposed directly over the central conductor 12 as in FIG. 1, or as a tube over a dual-filament wrap as in FIG. 2, is produced using a high-tolerance melt extrusion machine. The extruder is set up according to a desired temperature profile, in conjunction with a post-extrusion cooling water bath that cools the extruded insulator 14 at a controlled cooling rate, for reducing sagging and to ensure that the FEP insulator bonds with the central conductor (in the case of the cable 10 in FIG. 1). Initial settings are chosen based on the particular FEP material used, and then adjusted using trial and error, according to standard extrusion manufacturing methods.

The example is of typical cable component dimensions characteristic in both PTFE & FEP constructions.

Example 1

FIG. 1

Central conductor: 24 AWG, 0.0201" silver-plated copper
Dielectric insulator: High-purity FEP, 0.066"+0.001" OD
Inner shield: Helically overlapped, flat, silver-plated copper
Braid shield: 40 AWG silver plated copper, >90% coverage
Overall shield diameter: 0.086" nominal
Outer jacket: FEP, 0.0075" wall thickness
Impedance: 50±1Ω
Capacitance: 29 pF/ft
Overall diameter "D": 0.101"±0.005"

Figure 4:
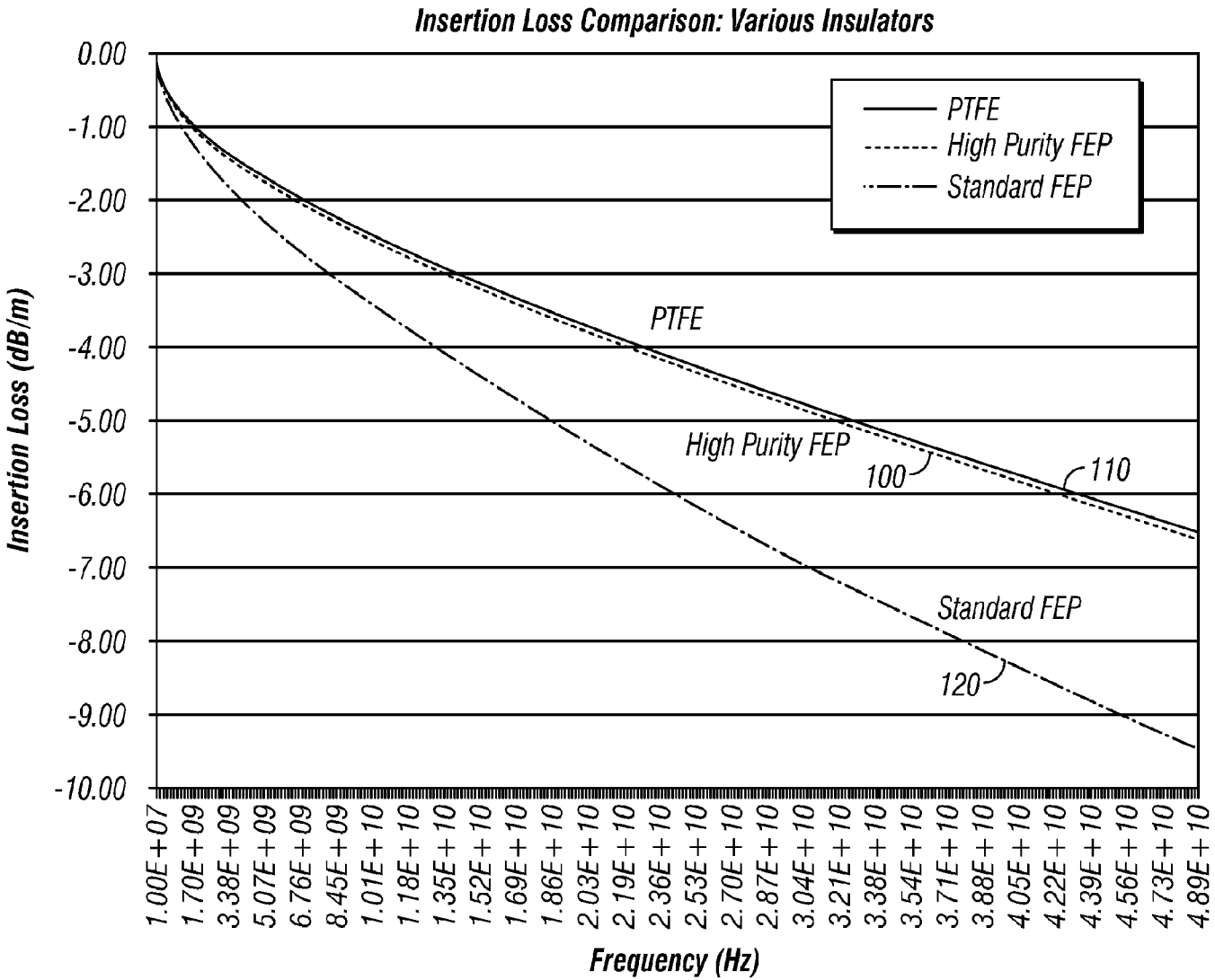
FIG. 4 is a graph showing signal insertion loss as a function of frequency for coaxial cables with high-purity FEP, PTFE, and conventional FEP insulators.

FIG. 4 shows a comparative graph of the insertion loss (in dB) of equivalent coaxial cables but with different dielectric insulators, as a function of frequency (in Hz). In this context, insertion loss (also known as attenuation) is a measure of the overall decrease in transmitted signal power through a coaxial cable, which results from radiation losses, resistive losses in the conductor, line terminations, losses in the dielectric insulator, etc. Insertion loss is characterized as the ratio of the signal power received by the load (PR) to the power transmitted by the source (PT):

$$\text{Insertion loss}=PR/PT$$

Since insertion loss represents a decrease in signal power, it is usually expressed as a negative dB value. For maximum power transfer (indicating a better performing cable), the insertion loss should be as small as possible, e.g., as close to 0 dB as possible. For coaxial cables, insertion loss varies with the frequency of the transmitted signal.

The graph in FIG. 4 includes the insertion loss values for three coaxial cables, in a frequency range of about 1 GHz to 50 GHz. The cables were dimensioned and configured similarly, according to Example 1 above and FIG. 1, but with different dielectric insulators which include: high-purity FEP 100 (NP1101), solid PTFE 110, and a general purpose, standard FEP 120 (Daikin® NP-20) for extruded wire and cable insulation. Each cable was 1 meter in length, with 2.4 MM connectors. As indicated in FIG. 4, across most of the frequency range, and in particular at higher frequencies, the coaxial cable with the high-purity FEP insulator 100 had a lower insertion loss and was essentially equal to the coaxial cable with a solid PTFE insulator 110, and much better performance levels than conventional FEP 120, (nearly 50% better at 50 GHz).

One embodiment of the invention can be characterized as a coaxial cable for carrying electrical signals, where the cable comprises: a central conductor; a dielectric insulator disposed over the central conductor and co-axial therewith; an inner conductive shield disposed over the insulator and co-axial with the central conductor; and an outer insulator jacket disposed over the inner conductive shield; wherein the dielectric insulator comprises a high-purity FEP. In another embodiment, the insulator consists essentially of high-purity FEP.

Although the cable has been illustrated as incorporating a high-purity FEP dielectric insulator, a high-purity PFA (PerFluoroAlkoxy) insulator may also be used in certain embodiments.

Since certain changes may be made in the above-described ultra high-speed coaxial cable, without departing from the spirit and scope of the invention herein involved, it is intended that all of the subject matter of the above description or shown in the accompanying drawings shall be interpreted merely as examples illustrating the inventive concept herein and shall not be construed as limiting the invention.

What is claimed is:

1. A hot-melt extruded cable for ultra high-speed communication of high-frequency signals in the microwave frequency spectrum, said cable comprising:

a longitudinal conductor;

an insulator sheath covering said longitudinal conductor;

an inner conductive sheath disposed about an outer periphery of said insulator sheath;

an outer insulator jacket disposed about an outer periphery of said inner conductive sheath; and wherein said insulator sheath is manufactured from a high-purity fluorinated ethylene propylene.

2. The cable of claim 1 wherein said high-purity fluorinated ethylene propylene has a dissipation factor of 0.0005 or less at 2.45 GHz.

3. The cable of claim 1 wherein said cable is capable of carrying signals in the range of about 1 to about 50 GHz.

4. The cable of claim 1 wherein said cable has a signal bandwidth of greater than about 50 GHz.

5. The cable of claim 1 wherein said cable has an impedance tolerance of about ±1Ω.

6. The cable of claim 1 wherein said insulator sheath has a dimensional tolerance of about ±1 mil.

7. The cable of claim 1 wherein said cable has a minimum velocity of propagation of about 70%.

8. The cable of claim 1 wherein said cable further includes an outer conductive sheath disposed between said inner conductive sheath and said outer insulator jacket.

9. The cable of claim 1 wherein said longitudinal conductor is comprised of a plurality of individual conductors.

10. A hot melt extruded coaxial cable for ultra high-speed communication of high-frequency signals in the microwave spectrum, said cable comprising:

a longitudinal conductor;

a support wrap helically wound about said conductor;

an insulator sheath covering said support wrap and said longitudinal conductor, said insulator sheath being supported by said support wrap and offset from said conductor at a number of support locations to form an air-space between said conductor and insulator sheath;

an inner conductive sheath disposed about an outer periphery of said insulator sheath;

an outer insulator jacket disposed about an outer periphery of said inner conductive sheath; and wherein said insulator sheath is manufactured from a high-purity fluorinated ethylene propylene.

11. The coaxial cable of claim 10 wherein said high-purity fluorinated ethylene propylene has a dissipation factor of 0.0005 or less at 2.45 GHz.

12. The coaxial cable of claim 10 wherein said cable is capable of carrying signals in the range of about 1 to about 50 GHz.

13. The coaxial cable of claim 10 wherein said cable has a signal bandwidth of greater than about 50 GHz.

14. The coaxial cable of claim 10 wherein said cable has an impedance tolerance of about ±1Ω.

15. The coaxial cable of claim 10 wherein said insulator sheath has a dimensional tolerance of about ±1 mil.

16. The coaxial cable of claim 10, made with high purity PFA twisted monofilaments, wherein said cable has a minimum of 82% velocity of propagation.

17. The coaxial cable of claim 10 wherein said cable further includes an outer conductive sheath disposed between said inner conductive sheath and said outer insulator jacket.

18. The coaxial cable of claim 10 wherein said longitudinal conductor comprises a plurality of individual conductors.

19. A method hot melt extrusion manufacturing an ultra high-speed coaxial cable, said method comprising the steps of:

helically winding a support wrap about a central longitudinal conductor according to a wrap pitch and comprising first and second insulator filaments helically twisted together according to a twist pitch;

covering the support wrap and longitudinal conductor with an insulator sheath of high purity fluorinated ethylene propylene;

disposing an inner conductive sheath about an outer periphery of said insulator sheath; and disposing an outer insulator jacket about an outer periphery of said inner conductive sheath.

20. The method of claim 19 further comprising the step of:

disposing an outer conductive sheath between said inner conductive sheath and said outer insulator jacket.

* * * * *